US007423600B2

(12) United States Patent
Ikeda et al.

(10) Patent No.: US 7,423,600 B2
(45) Date of Patent: Sep. 9, 2008

(54) VEHICULAR ANTENNA APPARATUS

(75) Inventors: Tomoki Ikeda, Fukushima-ken (JP); Norio Tanaka, Fukushima-ken (JP); Masashi Nakagawa, Fukushima-ken (JP); Satoru Komatsu, Saitama-ken (JP); Hiroshi Kuribayashi, Saitama-ken (JP); Hiroshi Iijima, Tokyo (JP); Hideaki Oshima, Tokyo (JP)

(73) Assignees: Alps Electric Co., Ltd., Tokyo (JP); Honda Motor Co., Ltd., Tokyo (JP); Nippon Sheet Glass Company, Ltd., Tokyo (JP)

( * ) Notice: Subject to any disclaimer, the term of this patent is extended or adjusted under 35 U.S.C. 154(b) by 0 days.

(21) Appl. No.: 11/807,229

(22) Filed: May 25, 2007

(65) Prior Publication Data

US 2007/0279307 A1 Dec. 6, 2007

(30) Foreign Application Priority Data

May 30, 2006 (JP) ..... 2006-150412

(51) Int. Cl.
*H01Q 1/32* (2006.01)

(52) U.S. Cl. ..... 343/713; 343/700 MS

(58) Field of Classification Search ..... 343/713, 343/700 MS, 711, 712
See application file for complete search history.

(56) References Cited

U.S. PATENT DOCUMENTS

| | | | | |
|---|---|---|---|---|
| 5,959,581 | A * | 9/1999 | Fusinski | 343/700 MS |
| 7,215,291 | B2 * | 5/2007 | Nakano et al. | 343/715 |
| 7,365,685 | B2 * | 4/2008 | Takeuchi et al. | 343/700 MS |
| 2006/0244667 | A1 * | 11/2006 | Thompson et al. | 343/713 |
| 2006/0273968 | A1 * | 12/2006 | Noro | 343/713 |

FOREIGN PATENT DOCUMENTS

| | | |
|---|---|---|
| JP | 6-53722 | 2/1994 |
| JP | 2006-13877 | 1/2006 |

* cited by examiner

*Primary Examiner*—Tho G Phan
(74) *Attorney, Agent, or Firm*—Beyer Law Group LLP

(57) ABSTRACT

A vehicular antenna apparatus includes a radiating conductor directly patterned on a glass surface of a vehicle, a base plate fixed to the glass surface, a frame screwed to the base plate, a power feeding substrate and a circuit substrate accommodated and held in the frame, a connecting small substrate electrically connecting both substrates, and a cover attached on the top of the frame. A patterned surface of the power feeding substrate is close to and faces the glass surface, and thereby indirect power feeding can be performed. Both ends of the connecting small substrate are received in connecting holes. A power feeding pattern and a preamplifier circuit are connected via a microstrip line.

4 Claims, 9 Drawing Sheets

VEHICULAR ANTENNA APPARATUS

CLAIM OF PRIORITY

This application claims benefit of the Japanese Patent Application No. 2006-150412 filed on May 30, 2006, which is hereby incorporated by reference.

BACKGROUND OF THE INVENTION

1. Field of the Invention

The present invention relates to a vehicular antenna apparatus fitted to the inner surface (the cabin-side glass surface) of a window of a vehicle, such as a motor vehicle, and more specifically, it relates to a vehicular antenna apparatus including an electronic circuit unit that includes a preamplifier circuit and that is fitted to a glass surface provided with a radiating conductor.

2. Description of the Related Art

Hitherto, there has been known a vehicular antenna apparatus that includes a radiating conductor provided on the cabin-side glass surface of the rear window or the front window of a motor vehicle and an electronic circuit unit including a preamplifier circuit and fitted to the glass surface and that can thereby receive a circularly-polarized wave or a linearly-polarized wave transmitted from a satellite or an earth station. This type of antenna apparatus has a longer life and a lower risk of theft compared to antenna apparatuses installed outside the cabin, for example, on the roof, and has a more excellent space factor and a wider viewing angle compared to antenna apparatuses installed inside the cabin and near a window.

In this type of vehicular antenna apparatus, the electronic circuit unit fitted to a glass surface of a vehicle includes a circuit substrate having a preamplifier circuit, and a housing accommodating and holding the circuit substrate. The radiating conductor provided on the glass surface is electrically connected to the circuit substrate via a means, and thereby power feeding to the radiating conductor and loading of received signals can be performed. Hitherto, as an example of such an electrical connecting means, there has been known a structure in which a piece of conductor integral with the housing and protruding outward is soldered to a power feeding point of the radiating conductor, and thereby the radiating conductor on the glass surface and the preamplifier circuit of the circuit substrate are connected via the piece of conductor (see, for example, Japanese Unexamined Patent Application Publication No. 6-53722). In a vehicular antenna apparatus having such a structure, power feeding to the radiating conductor is performed via the piece of conductor protruding from the housing. Therefore, the piece of conductor is easily influenced by external noise, and it is difficult to secure necessary reliability. A vehicular antenna apparatus whose reliability is improved by using a coaxial feeder line, which is not easily influenced by external noise, as an electrical connecting means, and by soldering the feeder line to a power feeding point of the radiating conductor (see, for example, Japanese Unexamined Patent Application Publication No. 2006-13877).

In the conventional proposal disclosed in Japanese Unexamined Patent Application Publication No. 2006-13877, a radiating conductor provided on a glass surface of a vehicle and a circuit substrate in a housing are connected with a feeder line, and thereby a vehicular antenna apparatus that is not easily influenced by external noise is realized. However, in such a conventional proposal, at the end of assembling the antenna apparatus, it is necessary to solder one end of the feeder line to a power feeding point of the radiating conductor provided on the glass surface and to lay the feeder line along a predetermined pathway to a feeding terminal of the circuit substrate. These tasks need to be performed inside the cabin and are therefore inefficient. Therefore, the assembling cost is likely to be high. In addition, a slight error in the position at which the feeder line is soldered and connected to the radiating conductor causes impedance mismatching, and therefore it is difficult to obtain excellent antenna properties.

SUMMARY OF THE INVENTION

The present invention provides a vehicular antenna apparatus that does not require a troublesome work for electrically connecting a radiating conductor provided on a glass surface of a vehicle and a circuit substrate held in a housing and whose assembling cost can be easily reduced and whose antenna properties can be easily improved.

In an aspect of the present invention, a vehicular antenna apparatus includes a radiating conductor, a power feeding substrate, a circuit substrate, a connecting small substrate, and a housing. The radiating conductor is provided on the cabin-side glass surface of a vehicular window. The power feeding substrate has a power feeding pattern provided on one surface thereof. The power feeding pattern faces the radiating conductor with a space therebetween. The circuit substrate has a radio wave reflecting conductor layer provided on its almost entire opposing surface facing the other surface of the power feeding substrate, and a preamplifier circuit provided on the surface on the opposite side from the opposing surface. The connecting small substrate has a microstrip line and is disposed between the circuit substrate and the power feeding substrate and substantially perpendicularly to both substrates. The housing accommodates and holds the power feeding substrate, the circuit substrate, and the connecting small substrate. One end of the microstrip line is connected to the preamplifier circuit, and the other end is connected to the power feeding pattern. The power feeding pattern is electromagnetically coupled to the radiating conductor, and thereby indirect power feeding can be performed.

In the vehicular antenna apparatus configured as above, a power feeding substrate having a power feeding pattern is electrically connected to a circuit substrate via a connecting small substrate, and the power feeding substrate, the circuit substrate, and the connecting small substrate are accommodated and held in a housing and are close to and face a glass surface of a vehicle. Therefore, the power feeding pattern provided on the power feeding substrate in the housing is electromagnetically coupled to the radiating conductor provided on the glass surface, and thereby indirect power feeding can be performed. Although a feeder line is not used, since the connection is performed in the housing, it is not easily influenced by external noise. Therefore, unlike the direct power feeding method using a feeder line, it is not necessary to perform the troublesome tasks of soldering a feeder line to a power feeding point and laying it, in the cabin. The working efficiency is improved, and therefore the assembling cost can be reduced. In addition, since the impedance can be easily matched, the antenna properties can be easily improved.

In the above-described configuration, it is preferable that the power feeding substrate have a connecting hole adjacent to the power feeding pattern, the circuit substrate have a connecting hole adjacent to the preamplifier circuit, and both ends of the connecting small substrate be received in the connecting holes. If such a configuration is adopted, the connecting small substrate can be easily fitted to the power feeding substrate and the circuit substrate, and thereafter both ends of the microstrip line can be easily connected, for example, by soldering to the power feeding pattern and the preamplifier circuit. In addition, since these tasks need not be performed in the cabin, the working efficiency is dramatically improved.

In addition, in the above-described configuration, it is preferable that a metal base plate surrounding the radiating conductor be fixed to the glass surface of the vehicle, the housing have a metal frame detachably fixed (for example, screwed) to the base plate, and the frame hold the periphery of the power feeding substrate and the periphery of the circuit substrate. In this case, since the housing accommodating and holding the power feeding substrate, the circuit substrate, and the connecting small substrate is detachable from the glass surface of the vehicle, when the circuit substrate and so forth are checked and/or replaced, it is not necessary to perform the troublesome tasks of detaching and attaching, and therefore the maintenance management can be easily performed.

DESCRIPTION OF THE PREFERRED EMBODIMENTS

Figure 1:
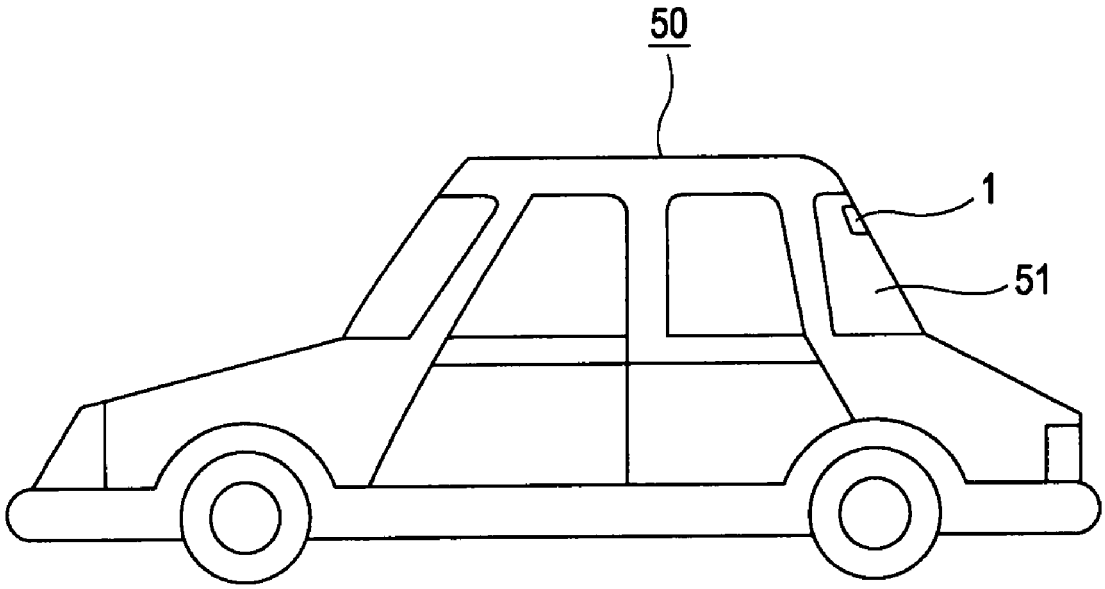
FIG. 1 is a side view of a motor vehicle and shows the position of a vehicular antenna apparatus according to an embodiment of the present invention.
Figure 2:
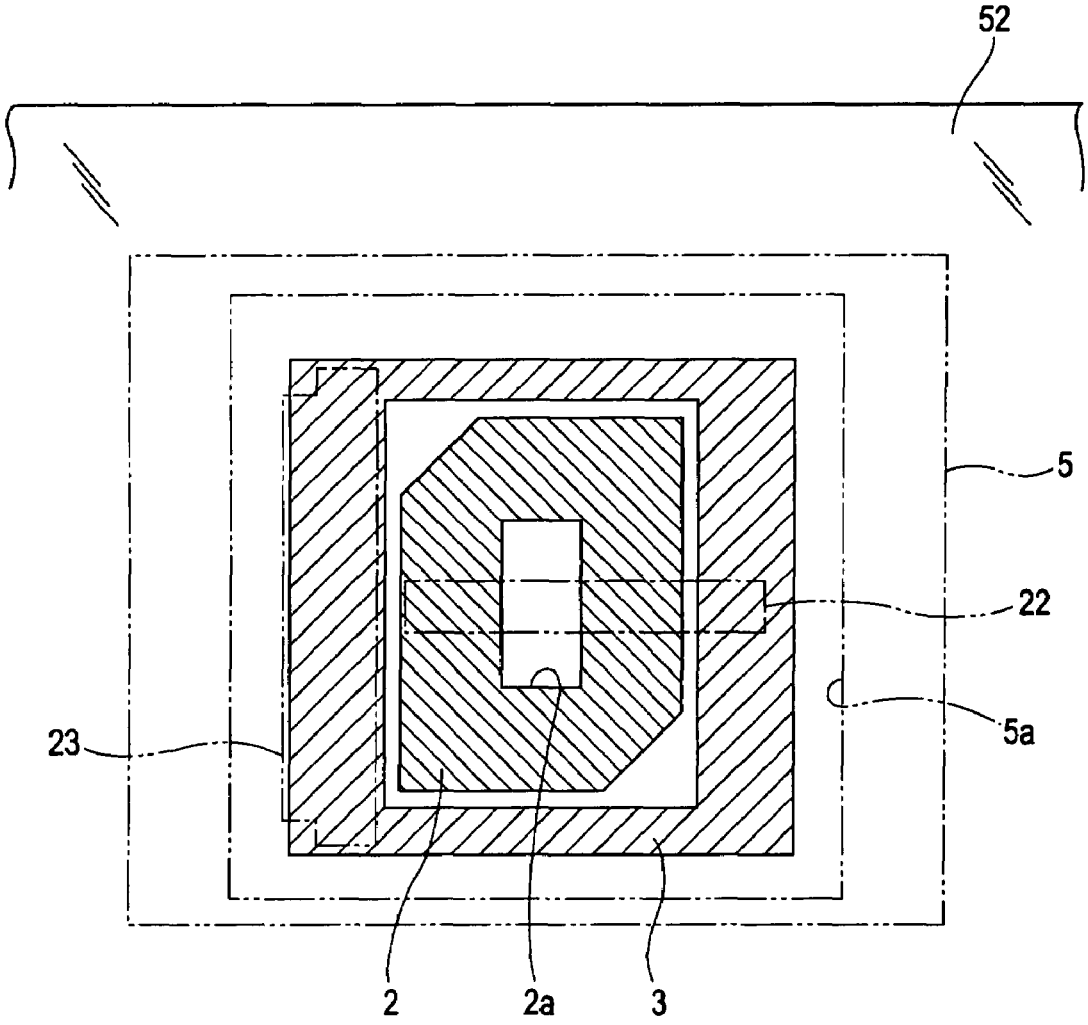
FIG. 2 is a front view showing a radiating conductor provided in the vehicular antenna apparatus.
Figure 3:
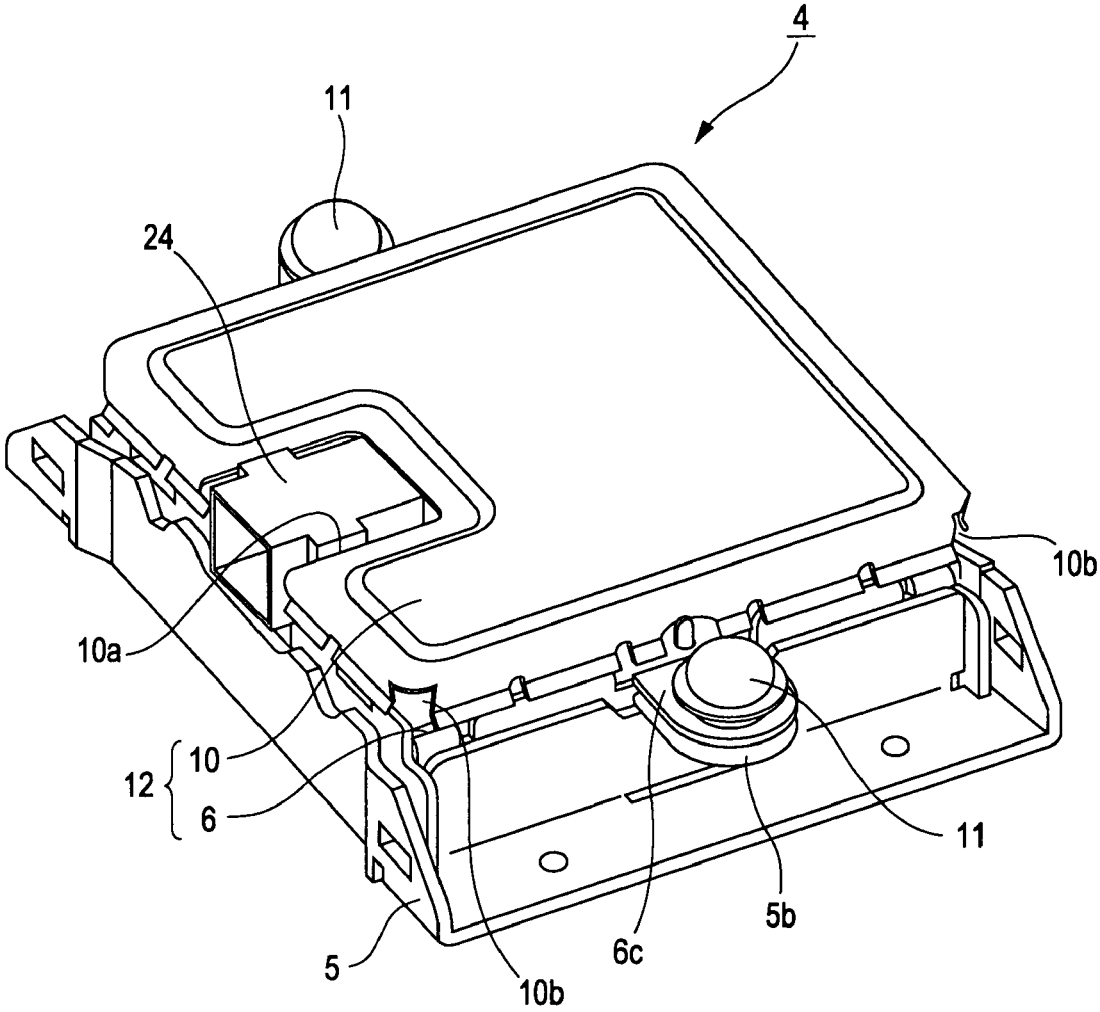
FIG. 3 is a perspective view showing an electronic circuit unit provided in the vehicular antenna apparatus.
Figure 4:
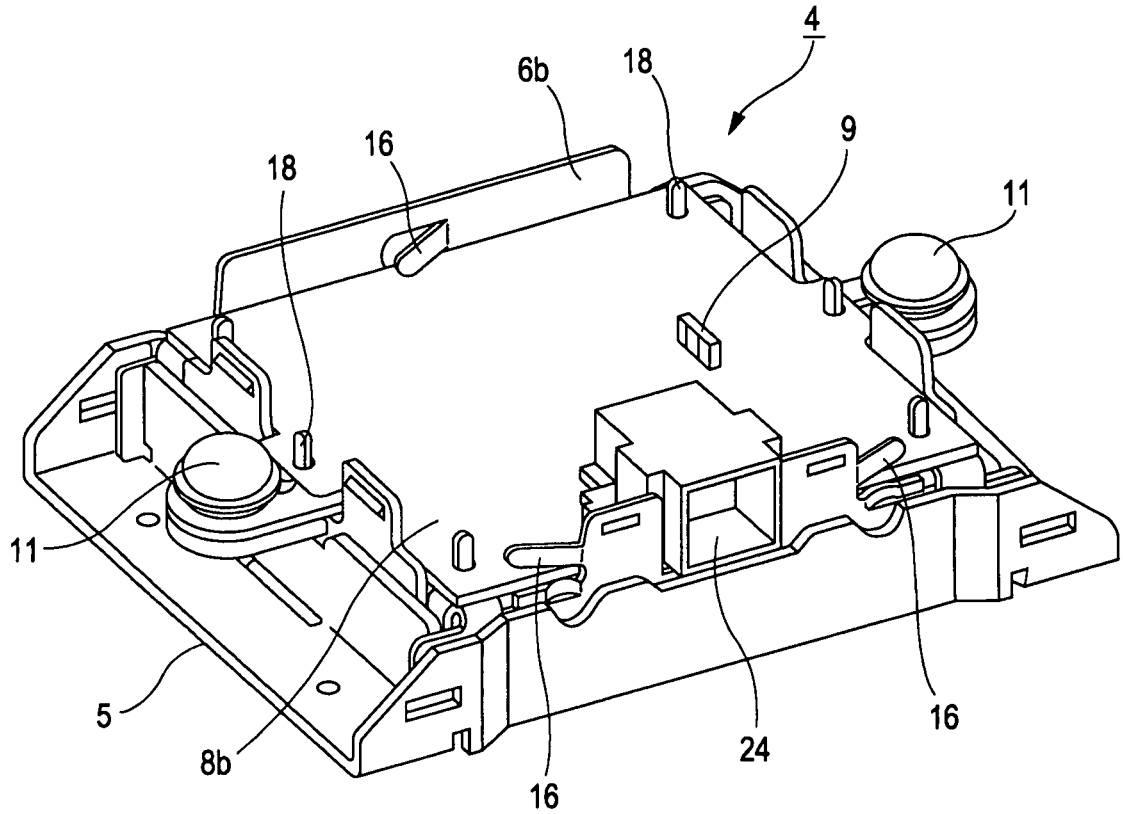
FIG. 4 is a perspective view of the electronic circuit unit with its cover removed.
Figure 5:
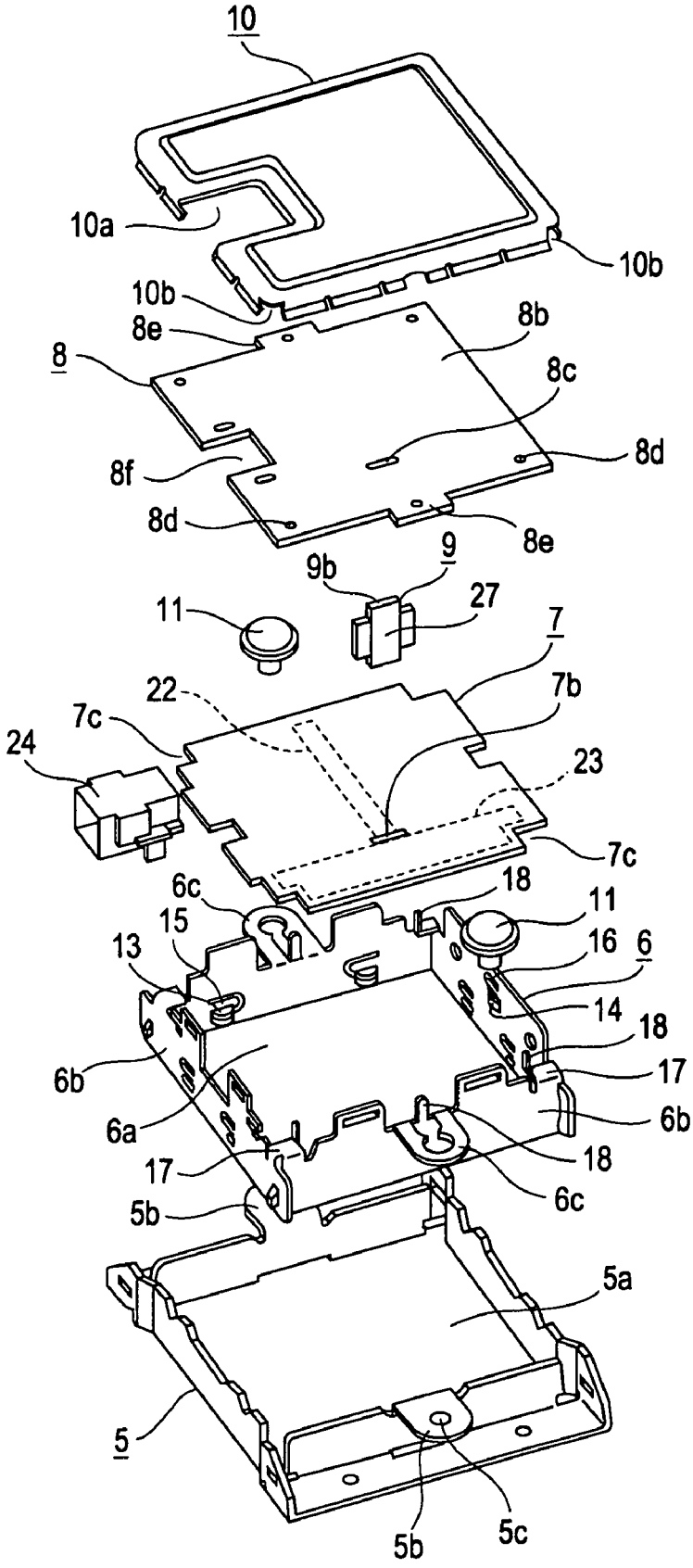
FIG. 5 is an exploded perspective view of the electronic circuit unit.
Figure 6:
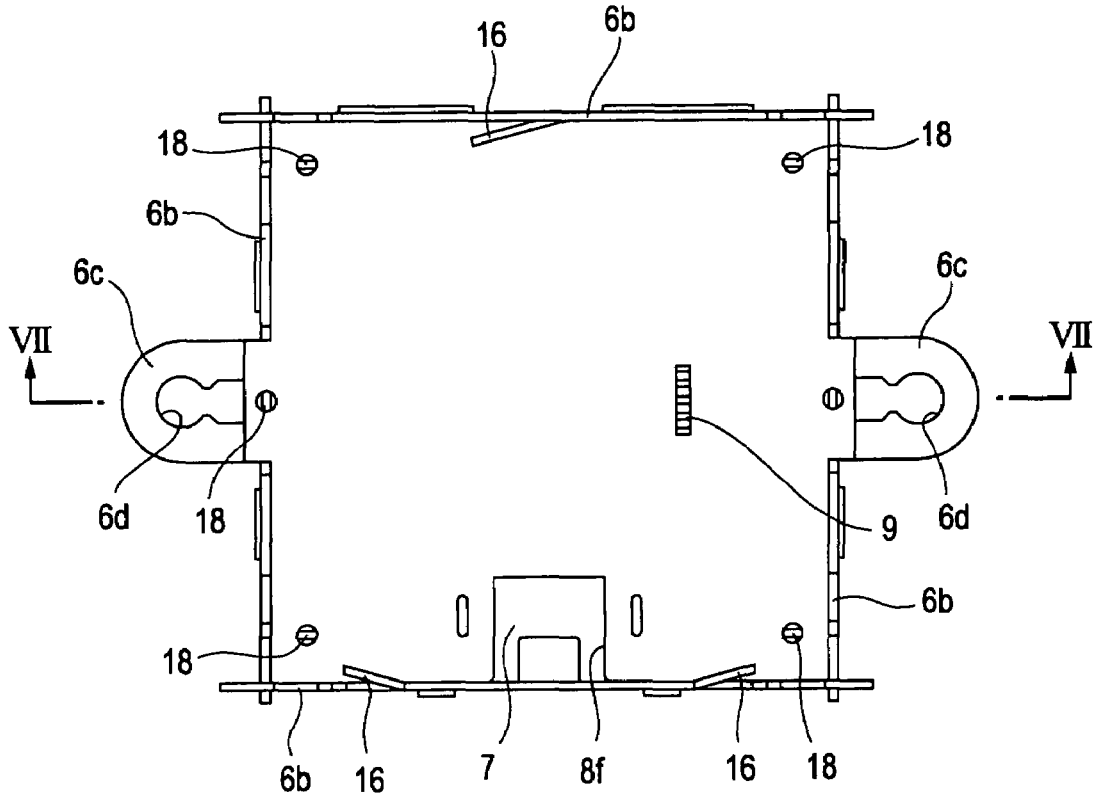
FIG. 6 is a plan view partially showing the electronic circuit unit.
Figure 7:
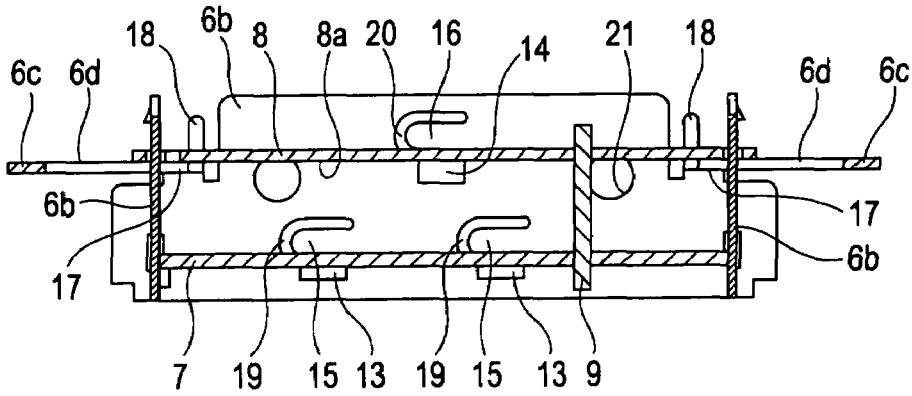
FIG. 7 is a sectional view taken along line VII-VII of FIG. 6.
Figure 8:
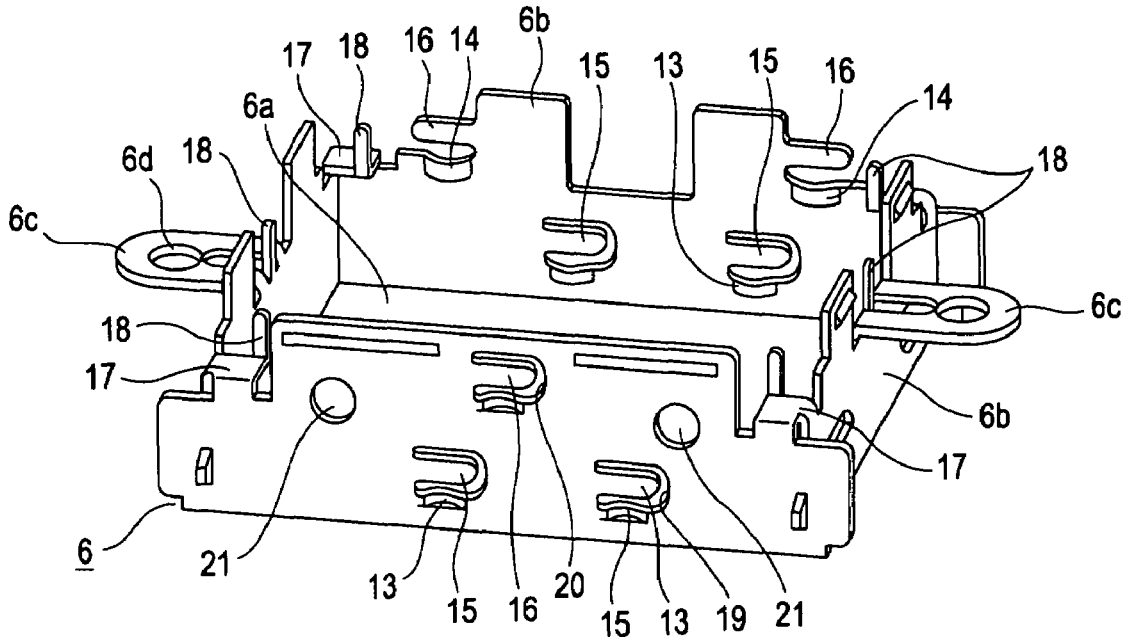
FIG. 8 is a perspective view showing a frame provided in the electronic circuit unit.
Figure 9:
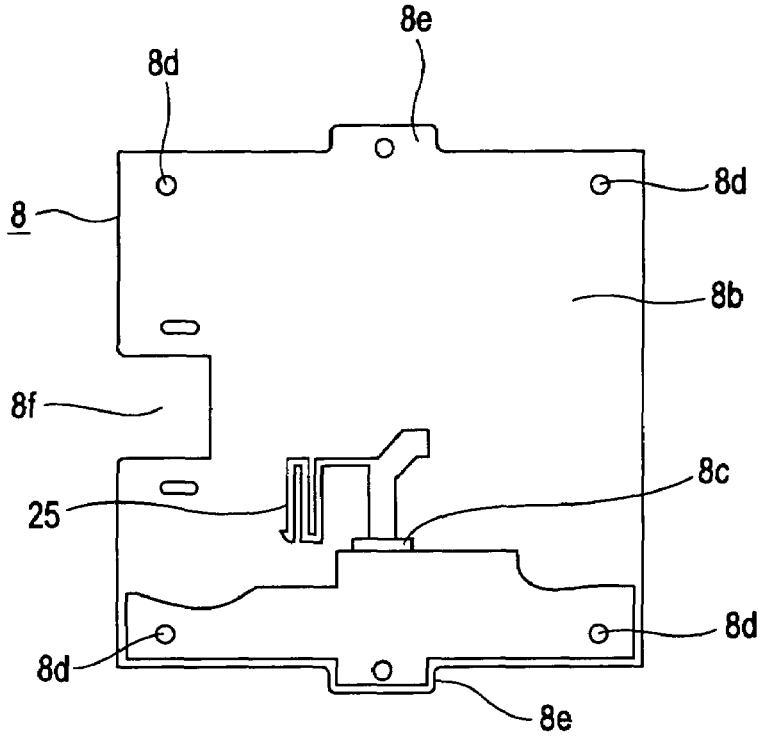
FIG. 9 is a plan view showing a circuit substrate provided in the electronic circuit unit.
Figure 10:
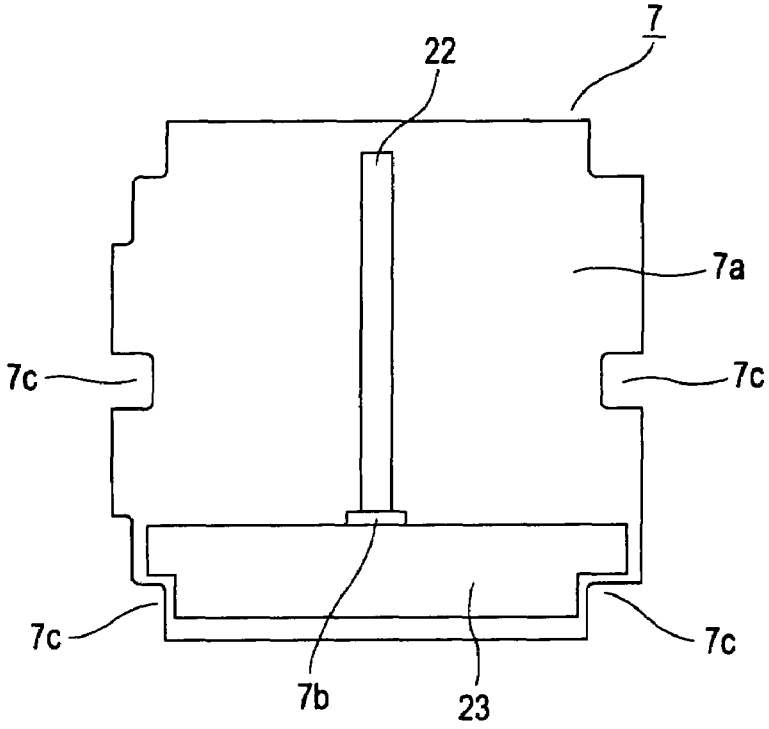
FIG. 10 is a plan view showing a power feeding substrate provided in the electronic circuit unit.
Figure 11A:
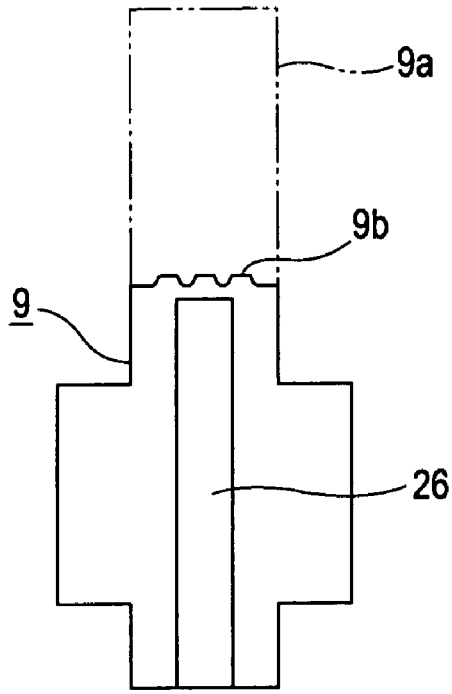
FIGS. 11A and 11B illustrate a connecting small substrate provided in the electronic circuit unit.
Figure 11B:
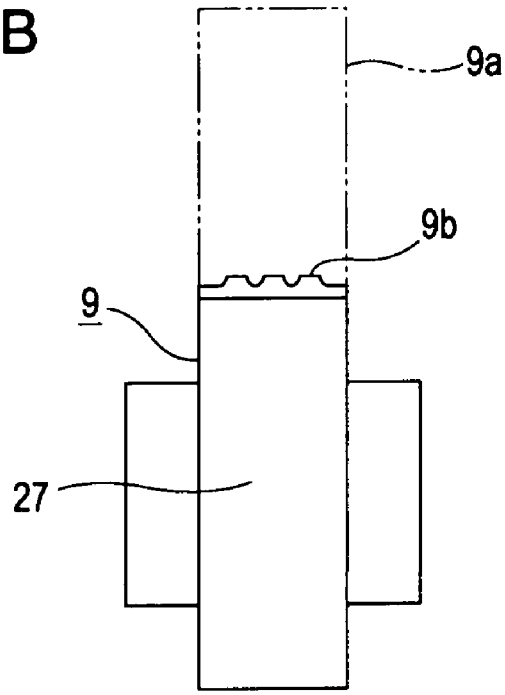

An embodiment of the present invention will now be described with reference to the drawings. FIG. 1 is a side view of a motor vehicle and shows the position of a vehicular antenna apparatus according to an embodiment of the present invention. FIG. 2 is a front view showing a radiating conductor provided in the vehicular antenna apparatus. FIG. 3 is a perspective view showing an electronic circuit unit provided in the vehicular antenna apparatus. FIG. 4 is a perspective view of the electronic circuit unit with its cover removed. FIG. 5 is an exploded perspective view of the electronic circuit unit. FIG. 6 is a plan view partially showing the electronic circuit unit. FIG. 7 is a sectional view taken along line VII-VII of FIG. 6. FIG. 8 is a perspective view showing a frame provided in the electronic circuit unit. FIG. 9 is a plan view showing a circuit substrate provided in the electronic circuit unit. FIG. 10 is a plan view showing a power feeding substrate provided in the electronic circuit unit. FIGS. 11A and 11B illustrate a connecting small substrate provided in the electronic circuit unit.

The vehicular antenna apparatus 1 according to this embodiment is formed on the inner surface of a window of a vehicle. It is fitted, for example, to the inner surface (the cabin-side glass surface 52) of the rear window 51 of a motor vehicle 50 as shown in FIGS. 1 and 2, and can receive broadcast waves. The vehicular antenna apparatus 1 includes a radiating conductor 2 and a ground conductor 3 that are patterned directly on the cabin-side glass surface 52, and an electronic circuit unit 4 fitted to the glass surface 52. The radiating conductor 2 has a slot 2*a* in the center. The ground conductor 3 entirely surrounds the radiating conductor 2. All components of the electronic circuit unit 4 are detachable from the glass surface 52, except a base plate 5.

As shown in FIGS. 3 to 7, the electronic circuit unit 4 includes a base plate 5, a frame 6, a power feeding substrate 7, a circuit substrate 8, a connecting small substrate 9, a cover 10, and a pair of fixing screws 11. The base plate 5 is formed of a sheet metal and has a rectangular opening 5*a*. The frame 6 is formed of a sheet metal and has a rectangular opening 6*a* having substantially the same shape as the opening 5*a*. The power feeding substrate 7 and the circuit substrate 8 are held in the frame 6 and are disposed parallel to each other in the opening 6*a*. The connecting small substrate 9 is disposed between both substrates 7 and 8 and substantially perpendicularly thereto. The cover 10 is formed of a sheet metal and is attached on the top of the frame 6 so as to cover the opening 6*a*. The frame 6 is detachably fixed to the base plate 5 by the fixing screws 11. The frame 6 and the cover 10 correspond to a housing 12 of the electronic circuit unit 4. The housing 12 accommodates and holds the power feeding substrate 7, the circuit substrate 8, the connecting small substrate 9, and so forth.

The base plate 5 has a pair of ears 5*b* that are opposite each other across the opening 5*a* and protrude outward. The ears 5*b* have internal thread holes 5*c* into which the fixing screws 11 are to be screwed. The base plate 5 is firmly fixed to the glass surface 52 in advance with a urethane adhesive, for example. At the end of the assembly process, the frame 6 is fixed to the base plate 5 with the fixing screws 11.

The frame 6 mainly includes four side plates 6*b* surrounding the rectangular opening 6*a*, and a pair of attachment ears 6*c* protruding outward from two side plates 6*b* opposite each other. The attachment ears 6*c* are provided at positions corresponding to the ears 5*b* of the base plate 5. The attachment ears 6*c* have through holes 6*d* through which the fixing screws 11 are to be passed. In addition, the frame 6 has first and second supports 13 and 14, first and second tongues 15 and 16, bearings 17, and guides 18. The first and second supports 13 and 14 are bent inward from the side plates 6*b*. The first and second tongues 15 and 16 are bent inward from the side plates 6*b* near the supports 13 and 14 (the tongues 15 and 16 shown in FIGS. 5 and 8 are not yet bent). The bearings 17 join adjacent side plates 6*b* at the four corners of the opening 6*a*. The guides 18 protrude from the proximal ends of the attachment ears 6*c* and the distal ends of the bearings 17. As shown in FIG. 7, the first supports 13 define the height of the power feeding substrate 7. The periphery of the power feeding substrate 7 is sandwiched in the thickness direction by the supports 13 and the tongues 15. By inward bending the supports 13 and the tongues 15, holes 19 are formed. In addition, the second supports 14 define the height of the circuit substrate 8. The periphery of the circuit substrate 8 is sandwiched in the thickness direction by the supports 14 and the tongues 16. By inward bending the supports 14 and the tongues 16 of the side plates 6*b*, holes 20 are formed. The bearings 17 provided at the four corners of the opening 6*a* define the height of the circuit substrate 8 as with the second supports 14. The four corners of the circuit substrate 8 are placed on the bearings 17. In addition, the frame 6 has a pair of drain holes 21 formed therein and making the inner space communicate with the outer space. The drain holes 21 are formed in one of the side plates 6*b* that is the lowest one disposed on the ground side when the antenna apparatus is fitted to the glass surface 52.

Held in the frame 6, the power feeding substrate 7 is disposed close to the glass surface 52. One surface (the surface facing the glass surface 52) of the power feeding substrate 7 is a patterned surface 7*a* provided with a power feeding pattern 22 and a ground pattern 23 (see FIG. 10). As shown in FIG. 2, the power feeding pattern 22 is mainly provided so as to face the radiating conductor 2, and the ground pattern 23 is provided so as to face the ground conductor 3. The power feeding substrate 7 has a connecting hole 7*b* into which one end of the connecting small substrate 9 is to be inserted. The connecting hole 7*b* is located between the power feeding pattern 22 and the ground pattern 23 and is adjacent thereto. In addition, on the periphery of the power feeding substrate 7 are provided a plurality of cutouts 7*c* so as to face the second supports 14 and the bearings 17.

The circuit substrate 8 is held in the frame 6 so as to face the power feeding substrate 7 with a predetermined distance therefrom. One surface (the surface facing the power feeding substrate 7) of the circuit substrate 8 is a radio wave reflecting surface 8*a*. On almost the entire surface of the radio wave reflecting surface 8*a* is provided a conductor layer. The other surface of the circuit substrate 8 is a component mounting surface 8*b* on which electronic components (not shown) and a connector 24 are mounted. On the component mounting surface 8*b* is provided a preamplifier circuit 25 (partly shown in FIG. 9). As shown in FIG. 5, the circuit substrate 8 has a connecting hole 8*c* into which the other end of the connecting small substrate 9 is to be inserted. The connecting hole 8*b* is located between a feeding terminal and a ground terminal of the preamplifier circuit 25 and is adjacent thereto. In addition, on the periphery of the circuit substrate 8 are provided a plurality of location holes 8*d* into which the guides 18 of the frame 6 are to be inserted. Moreover, protrusions 8*e* are provided so as to face the proximal ends of the attachment ears 6*c* of the frame 6. Furthermore, a large cutout 8*f* is formed in a place where the connector 24 is mounted.

Both ends of the connecting small substrate 9 are inserted into the connecting holes 7*b* and 8*c*, and thereby the connecting small substrate 9 is disposed substantially perpendicularly to the power feeding substrate 7 and the circuit substrate 8. As shown in FIG. 11A, a microstrip line 26 is provided on one surface of the connecting small substrate 9. As shown in FIG. 11B, a ground line 27 is provided on the other surface of the connecting small substrate 9. The power feeding substrate 7 side end of the microstrip line 26 is soldered to the power feeding pattern 22. The circuit substrate 8 side end of the microstrip line 26 is soldered to the feeding terminal of the preamplifier circuit 25. The power feeding substrate 7 side end of the ground line 27 is soldered to the ground pattern 23. The circuit substrate 8 side end of the ground line 27 is soldered to the ground terminal of the preamplifier circuit 25. As shown in FIGS. 11A and 11B by a two-dot chain line, the connecting small substrate 9 is provided in advance with a substrate extension 9*a* extending in the longitudinal direction from one end thereof on the circuit substrate 8 side. At the proximal end of the substrate extension 9*a* is formed a cutting facilitator 9*b* that is a perforated line. The substrate extension 9*a* is for improving the assembling efficiency. When the power feeding substrate 7, the connecting small substrate 9, and the circuit substrate 8 are sequentially fitted to the frame 6, the connecting small substrate 9 is inserted into the connecting hole 7*b* of the power feeding substrate 7 so as to stand upright, and then the upper end of the connecting small substrate 9 is inserted into the connecting hole 8*c* of the circuit substrate 8. At this time, the substrate extension 9*a* serves as a guide facilitating the insertion. Thereafter, the substrate extension 9*a* is cut off at the cutting facilitator 9*b* and is removed from the connecting small substrate 9. The connecting small substrate 9 and the circuit substrate 8 is formed from a common substrate material. The piece cut out of the circuit substrate 8 to form the cutout 8*f* is used as the connecting small substrate 9. Therefore, compared to the case where the circuit substrate 8 and the connecting small substrate 9 are separately manufactured, the cost can be dramatically reduced.

The cover 10 is attached on the top of the frame 6 by snap-fitting, for example. Most of the component mounting surface 8*b* of the circuit substrate 8 is covered by the cover 10. The cover 10 has a relief 10*a* formed in a side plate and the top plate thereof. The connector 24 mounted on the component mounting surface 8*b* is exposed through the relief 10*a*. Therefore, with the cover 10 attached to the frame 6, a coaxial cable (not shown) extending from an external receiver can be attached to or detached from the connector 24. At the four corners of the cover 10 are formed cutouts 10*b* for avoiding the contact between adjacent side plates. Due to these cutouts 10*b*, the cover 10 can be easily formed.

Next, the assembly process of the above-described electronic circuit unit 4 will be described. First, the power feeding substrate 7 is inserted into the opening 6*a* from above the frame 6, with the patterned surface 7*a* down, so that the periphery of the patterned surface 7*a* comes into contact with the first supports 13. The power feeding substrate 7 is positioned by the side plates 6*b* and the first supports 13. At a predetermined position in the frame 6, the periphery of the power feeding substrate 7 is supported by the first supports 13. On the periphery of the power feeding substrate 7 are formed cutouts 7*c*. Due to these cutouts 7*c*, the interference with the bearings 17 and the second supports 14 protruding toward the inside of the frame 6 is avoided. Therefore, the power feeding substrate 7 can be smoothly fitted.

Next, the end of the connecting small substrate 9 on the opposite side from the substrate extension 9*a* is inserted into the connecting hole 7*b* of the power feeding substrate 7 so that the connecting small substrate 9 stands upright on the power feeding substrate 7. Thereafter, the circuit substrate 8 is fitted to the frame 6 with the radio wave reflecting surface 8*a* down. The radio wave reflecting surface 8*a* is thereby disposed so as to face the power feeding substrate 7 with a predetermined distance therefrom. At this time, the substrate extension 9*a* of the connecting small substrate 9 protrudes above the guides 18 of the frame 6. The tip of the substrate extension 9*a* is aligned with and inserted into the connecting hole 8*c* of the circuit substrate 8, and then the guides 18 are inserted into the location holes 8*d* of the circuit substrate 8. At this time, the tip of the substrate extension 9*a* protruding far from the power feeding substrate 7 can be easily inserted into the connecting hole 8*c* of the circuit substrate 8. Since the circuit substrate 8 is first roughly positioned by the substrate extension 9*a*, the guides 18 can be easily inserted into the location holes 8*d*. Guided by the guides 18, the circuit substrate 8 is fitted to the frame 6. At a predetermined position in the frame 6, the periphery of the circuit substrate 8 is supported by the bearings 17 and the second supports 14, and the protrusions 8*e* of the circuit substrate 8 are supported by the proximal ends of the attachment ears 6*c*.

Thus, the power feeding substrate 7 and the circuit substrate 8 are disposed at their predetermined positions in the frame 6. The connecting small substrate 9 is held upright and substantially perpendicularly to the substrates 7 and 8. The substrate extension 9*a* protrudes upward and far from the connecting hole 8*c*. Next, the first tongues 15 are bent inward, and thereby the periphery of the power feeding substrate 7 is held between the tongues 15 and the first supports 13. Similarly, the second tongues 16 are bent inward, and thereby the periphery of the circuit substrate 8 is held between the tongues 16 and the second supports 13. Thus, the power feeding substrate 7 and the circuit substrate 8 are fixed to the frame 6. Thereafter, the substrate extension 9*a* is cut off at the cutting facilitator 9*b* and is removed from the connecting small substrate 9. Since the cutting facilitator 9*b* is a perforated line, this cutting can be easily performed without using any jig.

Thereafter, one end of the microstrip line 26 of the connecting small substrate 9 is soldered to the power feeding terminal of the preamplifier circuit 25, and the other end is soldered to the power feeding pattern 22. In addition, one end of the ground line 27 is soldered to the ground terminal of the preamplifier circuit 25, and the other end is soldered to the ground pattern 23. Thus, the power feeding pattern 22 and the ground pattern 23 of the power feeding substrate 7 are electrically connected to the power feeding terminal and the ground terminal, respectively, of the preamplifier circuit 25 via the connecting small substrate 9. In addition, the first supports 13 are soldered to the periphery of the patterned surface 7*a* of the power feeding substrate 7, and the guides 18 and the second tongues 16 are soldered to the periphery of the component mounting surface 8*b* of the circuit substrate 8. The power feeding substrate 7 and the circuit substrate 8 are firmly fixed to the frame 6, and thereby sufficient mechanical strength is secured. The substrate extension 9*a* may be cut off after the microstrip line 26 and the grounding line 27 have been soldered.

Next, the cover 10 is attached on the top of the frame 6 so as to cover the component mounting surface 8*b* of the circuit substrate 8. In the cabin, the frame 6 is inserted into the opening 5*a* of the base plate 5 fixed to the glass surface 52, the attachment ears 6*c* are placed on the ears 5*b*, and the fixing screws 11 are passed through the through holes 6*d* and are screwed into the internal thread holes 5*c*. Thus, the frame 6 is screwed to the base plate 5, and thereby the electronic circuit unit 4 is fitted to the glass surface 52. The power feeding pattern 22 is close to and faces the radiating conductor 2, and the ground pattern 23 is close to and faces the ground conductor 3. Therefore, if a coaxial cable (not shown) extending from an external receiver is connected to the connector 24, the power feeding pattern 22 is electromagnetically coupled to the radiating conductor 2 and the ground conductor 3, and the ground pattern 23 is electromagnetically coupled to the ground conductor 3. Indirect power feeding can thereby be performed, and broadcast waves can be received. Since the frame 6 fitted to the glass surface 52 has the drain holes 21 and the holes 19 and 20 formed in its lowest side plate 6*b* disposed on the ground side, water droplets entering in the inner space are quickly drained.

As described above, in the vehicular antenna apparatus 1 according to this embodiment, the power feeding substrate 7 electrically connected to the circuit substrate 8 via the connecting small substrate 9 is accommodated and held in the frame 6 (in the housing 12), and the power feeding substrate 7 is close to and faces the inner surface (the cabin-side glass surface 52) of a window such as the rear window 51. The power feeding pattern 22 is electromagnetically coupled to the radiating conductor 2 and the ground conductor 3, and thereby indirect power feeding can be performed. Although a feeder line is not used, since the connection is performed in the housing 12, it is not easily influenced by external noise. Therefore, unlike the direct power feeding method, it is not necessary to perform the troublesome tasks of soldering a feeder line to a power feeding point and laying it, in the cabin. The working efficiency is improved, and therefore the assembling cost can be reduced. In addition, since the impedance can be easily matched, the antenna properties can be easily improved.

In addition, in the vehicular antenna apparatus 1, the base plate 5 is fixed to the glass surface 52 in advance, the frame 6 to which the power feeding substrate 7, the circuit substrate 8, and so forth are fitted is fixed to the base plate 5 with screws, for example, and thereby the electronic circuit unit 4 is fitted to the glass surface 52. That is to say, the frame 6 is detachable from the glass surface 52. Therefore, when the circuit substrate 8 and so forth are checked and/or replaced, it is not necessary to perform the troublesome tasks of detaching and attaching, and therefore the maintenance management can be easily performed.

In addition, the vehicular antenna apparatus 1 is designed such that the frame 6 formed of a sheet metal has bent portions, such as the first and second supports 13 and 14 and the first and second tongues 15 and 16, formed in its side plates 6*b*, the periphery of the power feeding substrate 7 is sandwiched in the thickness direction by the supports 13 and the tongues 15, and the periphery of the circuit substrate 8 is sandwiched in the thickness direction by the supports 14 and the tongues 16. When the substrates 7 and 8 are fitted to the frame 6, the first supports 13 define the height of the power feeding substrate 7, and the second supports 14, the bearings 17, and so forth define the height of the circuit substrate 8. Therefore, the power feeding substrate 7 and the circuit substrate 8 can be fitted to the frame 6 easily and firmly with high positional accuracy without complicating the shape of the frame 6 and increasing the height thereof, and the cost and size of the electronic circuit unit 4 can be easily reduced.

In the housing 12 of the vehicular antenna apparatus 1, there are a first space defined between the glass surface 52 and the power feeding substrate 7, a second space defined between the power feeding substrate 7 and the circuit substrate 8, and a third space defined between the circuit substrate 8 and the cover 10. The first and second spaces communicate with each other via the cutouts 7*c* of the power feeding substrate 7, and also communicate with the outer space via the holes 19 and 20 and the drain hole 21 of the frame 6. The third space also communicates with the outer space via the cutouts around the bearings 17 of the frame 6 and the cutouts 10*b* of the cover 10. Water droplets due to dew condensation in the housing 12 and water droplets entering from the outside are quickly drained from any one of the first to third spaces. Therefore, the failure or malfunction caused by the water droplets entering the housing 12 cannot occur, the reliability is improved, and the life can be lengthened.

In the vehicular antenna apparatus 1, the patterned surface 7*a* of the power feeding substrate 7 is in contact with the first supports 13 and thereby the height is defined, and the radio wave reflecting surface 8*a* of the circuit substrate 8 is in contact with the second supports 14 and thereby the height is defined. Therefore, the patterned surface 7*a* and the radio wave reflecting surface can be easily disposed with predetermined distances from the radiating conductor 2 provided on the glass surface 52. Also in this respect, the antenna properties can be improved. However, in the case where the posi tional relationship between the supports 13 and 14 and the tongues 15 and 16 relative to the glass surface 52 is reversed, the height of the power feeding substrate 7 can be defined by bringing the surface on the opposite side from the patterned surface 7*a* (the surface facing the circuit substrate 8) into contact with the first supports 13, and the height of the circuit substrate 8 can be defined by bringing the component mounting surface 8*b* into contact with the second supports 14. In this case, the circuit substrate 8 is fitted to the frame 8 before the power feeding substrate 7.

In the above-described embodiment, the cutting facilitator 9*b*, which is a perforated line, is formed at the proximal end of the substrate extension 9*a* extending from the connecting small substrate 9, and thereby the substrate extension 9*a* can be easily cut off without using any jig. Instead of the perforated line, the cutting facilitator 9*b* may be a V-groove, for example. Also in this case, the same advantage can be obtained.

What is claimed is:

1. A vehicular antenna apparatus comprising:

a radiating conductor provided on the cabin-side glass surface of a vehicular window;

a power feeding substrate having a power feeding pattern provided on one surface thereof, the power feeding pattern facing the radiating conductor with a space therebetween;

a circuit substrate having a radio wave reflecting conductor layer provided on its almost entire opposing surface facing the other surface of the power feeding substrate, and a preamplifier circuit provided on the surface on the opposite side from the opposing surface;

a connecting small substrate having a microstrip line and disposed between the circuit substrate and the power feeding substrate and substantially perpendicularly to both substrates; and a housing accommodating and holding the power feeding substrate, the circuit substrate, and the connecting small substrate, wherein one end of the microstrip line is connected to the preamplifier circuit, the other end is connected to the power feeding pattern, the power feeding pattern is electromagnetically coupled to the radiating conductor, and thereby indirect power feeding can be performed.

2. The vehicular antenna apparatus according to claim 1, wherein the power feeding substrate has a connecting hole adjacent to the power feeding pattern, the circuit substrate has a connecting hole adjacent to the preamplifier circuit, and both ends of the connecting small substrate are received in the connecting holes.

3. The vehicular antenna apparatus according to claim 2, wherein a metal base plate surrounding the radiating conductor is fixed to the glass surface, the housing has a metal frame detachably fixed to the base plate, and the frame holds the periphery of the power feeding substrate and the periphery of the circuit substrate.

4. The vehicular antenna apparatus according to claim 1, wherein a metal base plate surrounding the radiating conductor is fixed to the glass surface, the housing has a metal frame detachably fixed to the base plate, and the frame holds the periphery of the power feeding substrate and the periphery of the circuit substrate.

* * * * *